United States Patent [19]

Schreyer

[11] 4,165,863

[45] Aug. 28, 1979

[54] HOIST SYSTEM

[75] Inventor: Kenneth D. Schreyer, Clarence, N.Y.

[73] Assignee: Columbus McKinnon Corporation, Tonawanda, N.Y.

[21] Appl. No.: 723,652

[22] Filed: Sep. 15, 1976

[51] Int. Cl.[2] ..... B66D 3/18

[52] U.S. Cl. ..... 254/168; 267/162; 294/82 R

[58] Field of Search ..... 254/168, 167, 135 R, 254/173, 189, 172, 9; 267/162; 188/1 B; 187/1 R; 267/73, 9, 79; 294/82 R

[56] References Cited

U.S. PATENT DOCUMENTS

| | | | |
|---|---|---|---|
| 1,990,163 | 2/1935 | Blackburn et al. | 254/167 |
| 2,712,932 | 7/1955 | Gould | 294/82 R X |
| 3,037,803 | 6/1962 | Phillips | 294/82 R |
| 3,318,575 | 5/1967 | Hawkins et al. | 254/167 |
| 3,371,919 | 5/1968 | Minor et al. | 267/73 |
| 3,401,972 | 9/1968 | Walsh | 294/82 |
| 3,436,724 | 4/1969 | Shigeta et al. | 187/1 R |
| 3,466,024 | 9/1969 | Spieth | 267/162 X |
| 3,759,351 | 9/1973 | Purple | 267/162 X |
| 3,883,119 | 5/1975 | Hansson | 254/168 |
| 3,918,301 | 11/1975 | Baer | 267/162 X |
| 3,957,248 | 5/1976 | Hannson | 254/168 |
| 3,998,432 | 12/1976 | Uldricks et al. | 254/168 |

FOREIGN PATENT DOCUMENTS

| | | | |
|---|---|---|---|
| 951195 | 7/1949 | Fed. Rep. of Germany | 267/162 |
| 250561 | 10/1926 | Italy | 267/162 |
| 454998 | 2/1950 | Italy | 254/167 |
| 16905 | of 1909 | United Kingdom | 267/162 |

*Primary Examiner*—Joseph F. Peters, Jr.
*Assistant Examiner*—D. W. Underwood
*Attorney, Agent, or Firm*—Bean, Kauffman & Bean

[57] ABSTRACT

In a load system which involves a powered chain hoist wherein raising or lowering of a load is effected by a rotating drive sprocket over which the chain is trained, the amplitude of motion due to resonant response of the load system as a consequence of coincidence between the natural frequency of the load system and the frequency of oscillatory excitation produced by the chain/sprocket drive is significantly reduced by providing an energy dissipation device in series with the load. This device involves a spring mechanism which permits a limited motion at the resonant condition, in combination with a controlled damping factor. The spring compliance of the device normally will lie in the range of about ½-3 times the spring compliance of the active length of the chain at the resonant condition and the relation between the spring rate of the device and the effective damping factor is perferably such that the spring rate divided by the damping factor will be at least about 0.006 seconds. The device so tuned is also effective in rapidly attenuating the amplitude of the transient motion induced when the hoist is suddenly stopped or started.

24 Claims, 10 Drawing Figures

V3 - SOLID HOOK RESONACE TEST WITH A LOAD OF 4,037 LBS.

V3- ENERGY DISSIPATION HOOK BLOCK (33 WASHERS) RESONANCE TEST (LUBED) WITH LOAD OF 4,037 LBS.

HOIST SYSTEM

BACKGROUND OF THE INVENTION

Motor driven chain hoists find a wide range of application in industry and are particularly useful because of their versatility. Typical applications require a hoist assembly which is relatively compact and of reasonably light weight. In order to produce such a hoist, several factors need to be considered. For example, the chain itself must be as light in weight as is practical for handling the loads for which the hoist is designed; the electric motor should be light in weight and compact; and the hoist components must also be compact and light in weight. Moreover, the hoist must be capable of raising and lowering the load at a relatively rapid velocity.

To those skilled in the art, it will be obvious that the above general requirements impose certain interrelated physical restrictions on the hoist construction. For example, if the electric motor is to be compact and of light weight, it must be expected that its power output will be relatively low. Consequently, the drive motor must operate to drive the hoist chain with high mechanical advantage if the load capacity of the hoist and the raising and lowering speeds are to be practical. This dictates the use of a drive sprocket which is of small diameter and which rotates at a relatively high angular velocity.

However, the smaller the drive sprocket, the more pronounced is the unevenness of motion inherently imparted to the chain as the load is raised or lowered. That is to say, since the chain is a flexible element comprising articulated chain links of finite lengths, the vertical motion of the chain in raising or lowering a load is the resultant of two motions. First, there is the constant velocity vertical motion which is a function of the angular speed of the sprocket wheel and its effective diameter and, superimposed upon this constant velocity vertical motion, there is an oscillatory vertical motion which is a function of the fact that the chain does not smoothly train over the sprocket wheel. Stated otherwise, it is impossible to impart a completely smooth drive motion to a chain when the drive is effected by a rotating drive sprocket. Moreover, the amplitude of the oscillatory motion increases as the size of the drive sprocket is decreased.

This superimposed oscillatory motion imposes additional alternating stresses upon the entire system over and above those induced by the steady load and since the amplitude of such oscillatory motion is increased as the effective diameter of the sprocket wheel is reduced, the added stress conditions are exacerbated by the above-noted requirements of a powered chain hoist.

Moreover, an additional problem arises because of the superimposed oscillatory motion described. This problem has to do with the fact that the load system which comprises the hoist, its support and the load which is suspended will possess a natural frequency due to spring rate characteristics inherent in the system and dependent upon the mass of the load. Since the inherent resiliency of the chain affects the spring rate of the system and since the effective length of that portion of the chain which supports the load is continuously changing as the load is raised or lowered, the natural frequency of the system likewise is constantly changing during raising or lowering. Consequently, if the oscillatory excitation due to the drive sprocket creates resonant response in the load system as the active length of the chain between the hoist and load approaches some value within the operating range of the hoist, the amplitude of the aforesaid oscillatory motion can become quite large and correspondingly large, increased stresses may be imposed upon the system.

Thus, even though the increased stresses do not exceed the ultimate strength of the chain or components of the hoist, they can become large enough to exceed the endurance limit of the chain and/or hoist components.

That is to say, the hoist and chain normally will be designed such that, absent the resonant conditions specified above, the endurance limits of the chain and hoist components are not exceeded, usually even in the presence of significant overload such as 150% of rated load. Theoretically, then, the hoist assembly would not fail in fatigue since it would be able to withstand an infinite number of stress cycles. However, the increased stresses produced by the aforesaid resonant conditions may well be sufficient to exceed the endurance limits of the chain and/or hoist components, causing fatigue failure after some finite number of stress cycles.

To overcome the above problem, attempts have been made to design systems in which the active length of the chain at which resonant response occurs lies outside the operating range of the hoist, or a limiting active length has been specified, outside of which the hoist should not be operated. Alternatively, the hoist operating speed may be reduced to avoid resonance. These solutions are not entirely successful because each limits the versatility of the hoist.

Another approach has been to introduce a resilient device in series with the chain and load to lower the range of natural frequencies which the system exhibits during raising and lowering, the lower natural frequency being such as to move any resonant condition outside the operating range of the hoist. This solution can be acceptable under limited circumstances and has been effected by the use of a stack of Belleville washers incorporated in the load hook of the hoist. Specifically, the Belleville washers introduced a soft enough spring element into the system as to require such a short active chain length at which resonance occurs as to be outside the operating range of the hoist. An undesirable side effect of this approach is that the soft or weak load hook spring allows considerable bouncing of the load during raising and lowering as well as a persistent transient oscillation induced by stopping the load. This is undesirable for several reasons. First of all, it makes it difficult accurately to position the load with the hoist. Further, noticeable bouncing of the load imparts the appearance of an unsafe condition even though none actually exists and an operator or persons standing nearby the load are understandably uncomfortable. Also, it can happen that the load is delicate or fragile and cannot tolerate the bouncing incurred.

BRIEF SUMMARY OF THE INVENTION

Accordingly, it is an object of this invention to provide an improved form of hoist or load handling system in which the aforesaid resonance and transient response problems are significantly reduced or eliminated.

Basically, the present invention involves the use of control means which obtains a controlled amplitude of relative motion within the control means in response to the oscillatory motion inherently produced, and which control means provides a damping force related to said controlled amplitude which significantly reduces the excessive oscillatory motion and forces which would otherwise result during resonant response.

In this way, the hoist can be designed for maximum versatility in operation and use, without regard to resonant responses, and the control means is then simply adapted to overcome the difficulties otherwise produced by resonant response. For example, the control means normally will be used to reduce the oscillatory motion and forces at resonance so that the endurance limits of the chain and hoist components are not exceeded. In this way, the chain and hoist components may be subjected to an indefinite number of stress cycles without fatigue failure.

It may also be necessary or desirable to design the control means so that readily visible bouncing of the load is eliminated or so that transient vibration amplitudes decay quickly to imperceptible levels.

In any event, it has been found that the control means should provide a combination of spring rate and damping factor which produces the desired reduction of excessive oscillatory motion and forces. In general, the spring rate of the control means and the damping factor of the control means must be interrelated to provide, under resonant response, a controlled amplitude of motion during which the damping factor dissipates sufficient energy to at least maintain the peak stresses in the chain and the components of the hoist below the endurance limits of the materials involved and to effect a decay of transient vibration amplitude to an unnoticeable level within a small time interval, say in the order of 1 second.

Conveniently, the control means takes the form of at least one set of Belleville washers wherein the energy dissipation is in the form of heat generated by relative rubbing between the washers. The coefficient of friction between washers may be controlled as by lubrication, by coating the washers, etc.

In another aspect of the invention, plural sets of Belleville washers are provided in series, each set having a different spring rate and related damping factor, with the sets being individually tuned to different resonant responses which may occur. The softest set may be tuned to respond principally to resonant responses which may occur with a load which is 50% of the rated capacity of the hoist, the stiffest set may be tuned to respond principally to resonant responses which may occur with a load which is 150% of the rated capacity of the hoist, and a washer set of intermediate stiffness may be tuned to an intermediate loading of the hoist, say 100% of rated capacity. Resonant responses may occur, for a given load, when the varying natural frequency coincides with the fundamental and/or a significant harmonic of the excitation frequency due to the chain/-sprocket drive.

The invention, in addition to reducing the oscillatory motion and forces incidental to resonant response also significantly reduces oscillatory motions incidental to acceleration and deceleration conditions, i.e., incidental to starting to raise the load and to stopping the load, particularly while the load is being lowered.

BRIEF DESCRIPTION OF THE DRAWING FIGURES

DETAILED DESCRIPTION OF THE INVENTION

Figure 1:
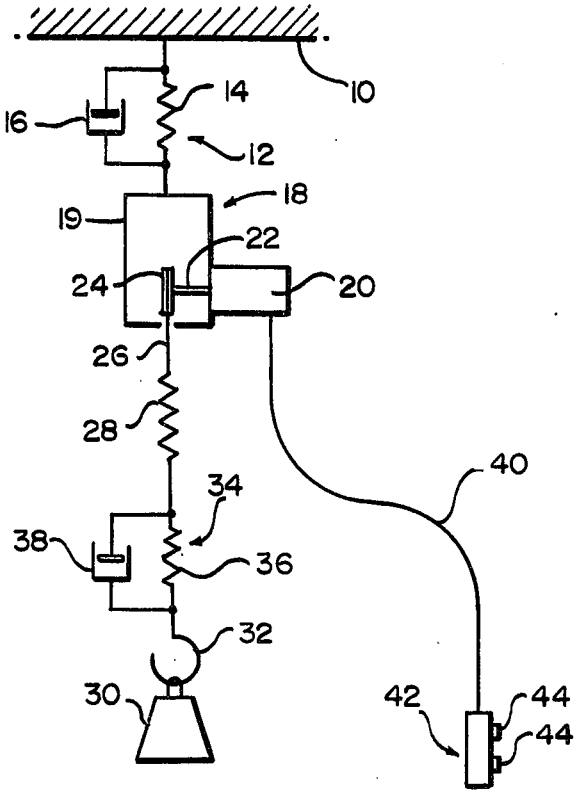
FIG. 1 is a diagrammatic view illustrating certain principles according to the present invention.

Referring now more particularly to FIG. 1, there is diagrammatically shown therein a load system incorporating the principles of the present invention. As illustrated, reference character 10 indicates a suitable overhead support from which the chain hoist assembly indicated generally by the reference character 18 is suspended. The means for attaching the hoist assembly 18 to the support structure 10 is indicated generally by the reference character 12 and typically the attachment and/or the nature of the support 10 will interpose into the load system a fixed spring rate as diagrammatically illustrated at 14 and also some viscous damping as is indicated generally by the reference character 16.

The hoist assembly 18 includes a suitable casing 19 and, attached thereto, a suitable drive mecanism 20 ordinarily in the form of an electric motor having a drive shaft 22 to which the drive sprocket 24 is attached. The reference character 26 diagrammatically illustrates the chain which is trained over the drive sprocket 24 and to which the load 30 which is to be raised or lowered is attached. The reference character 28 diagrammatically illustrates the spring rate of the active length of the chain, that is the length of the chain between the drive sprocket 24 and the load 30, the usual load hook being indicated at 32 whereby the lower end of the chain 26 is attached to the load 30 and the control means according to the present invention is illustrated generally by the reference character 34. As shown, the control means incorporates resilient means providing the spring rate indicated at 36 and, in parallel therewith, a damping means providing a damping factor as indicated at 38.

As will be well understood by those ordinarily skilled in the art, the electric drive motor 20 has a flexible electrical control cable 40 depending therefrom which terminates in a hand held switch control unit 42 by means of which the operator controls the motor 30 correspondingly to raise, lower or position the load 30. The switch assembly 42 includes the usual "up" button 44 and the usual "down" button 46, it being appreciated that the hoist assembly 18 will include some automatic brake means such that when neither of the switches 44 or 46 is actuated manually by the operator, the brake automatically comes into play to hold the load at the position at which hoist motion has ceased.

The entire load system as is illustrated in FIG. 1 will, in the absence of the control means 34, exhibit some particular natural frequency which is a function of the spring rates as diagrammatically illustrated at 14 and 28, the uncontrolled damping as indicated by the reference character 16, and the weight or mass of the load 30. The spring rate 28 is a function of the active length of the chain 26 between the drive sprocket 24 and the load 30 and the inherent resiliency of the chain. Thus, as the load 30 is raised or lowered, correspondingly to increase or decrease the active length of the chain 26, the system will pass through a continuously varying band of natural frequencies.

Figure 2:
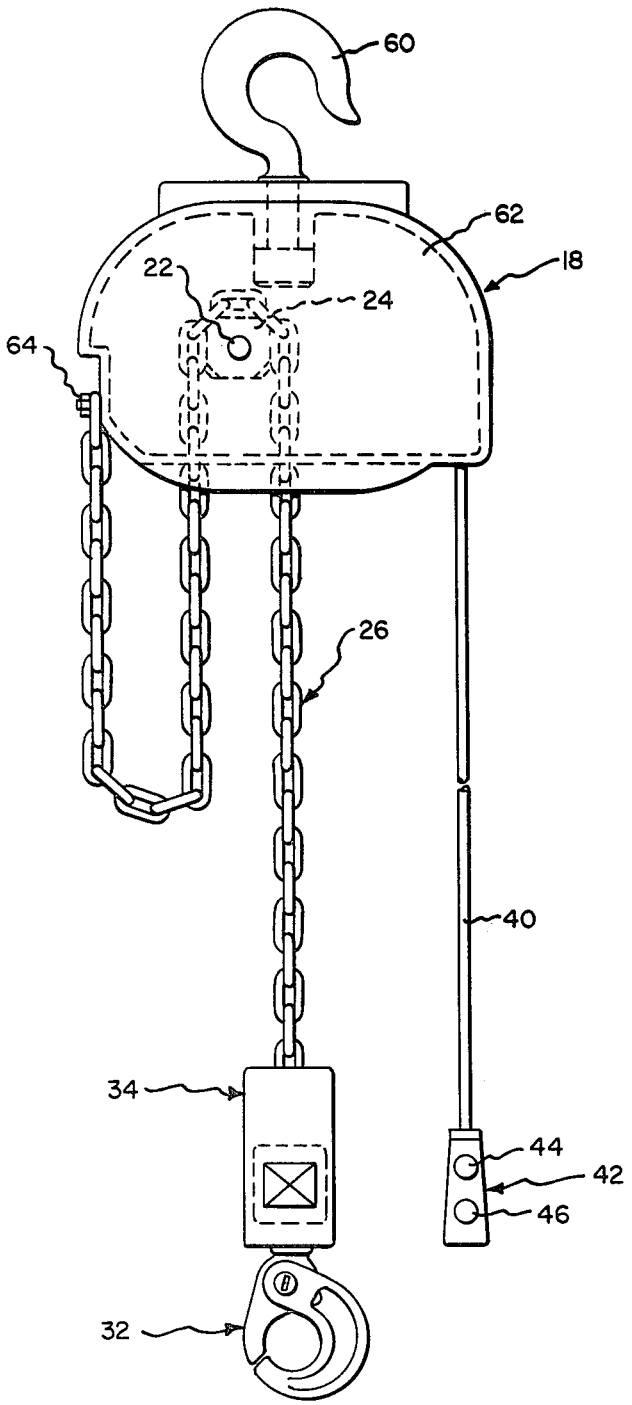
FIG. 2 is an elevational view showing one form of chain hoist with which the present invention may be utilized.

Referring to FIG. 2, it will be seen that the drive sprocket 24 is of non-circular configuration and, additionally, that it is of relatively small diameter, i.e., it contains relatively few pockets for receiving the individual chain links. Thus, as the drive motor 20 is rotated under constant speed conditions under control of the operator, the load 30 will have vertical motion imparted to it. This vertical motion is the result of two motions, one which is derived from the angular velocity of the drive sprocket 24 and its effective diameter, and the other of which is an oscillatory excitation superimposed upon the aforesaid by virtue of the uneven training of the chain over the drive sprocket 24.

Figure 6:
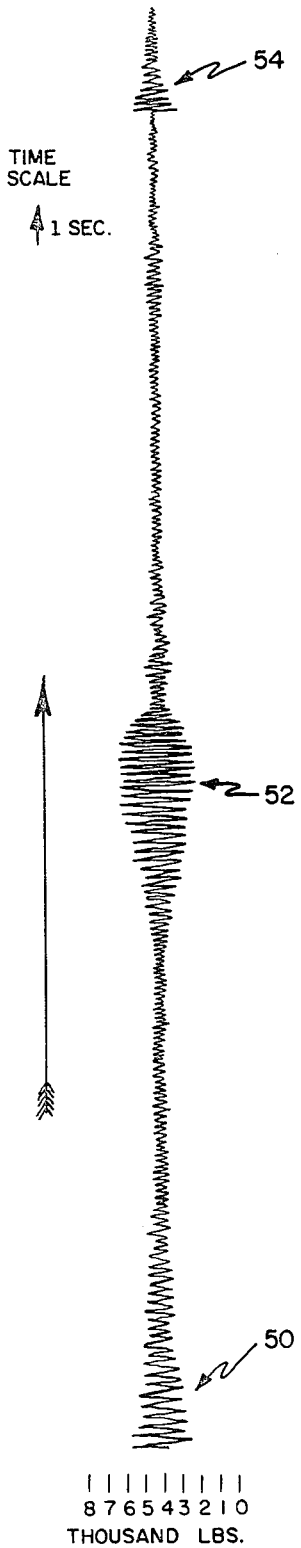
FIG. 6 is a recording of the tension in the active length of the chain during lifting of a load.

In consequence, it will be appreciated that for a particular mass and a particular active length of chain between the drive sprocket and the load 30, a resonant response for the system may occur due to the oscillatory excitation mentioned. Such a condition is illustrated in FIG. 6 for raising the load. In FIG. 6, the oscillatory response indicated generally by the reference character 50 occurs in response to the acceleration occurring when the load is initially moved. The oscillatory response indicated generally by the reference character 52 depicts a resonant response by the load system at a particular value of the active length of the chain and, lastly, the oscillatory motion indicated generally by the reference character 54 is that which occurs when the load has been raised to the desired height and the motion abruptly stopped.

Figure 7:
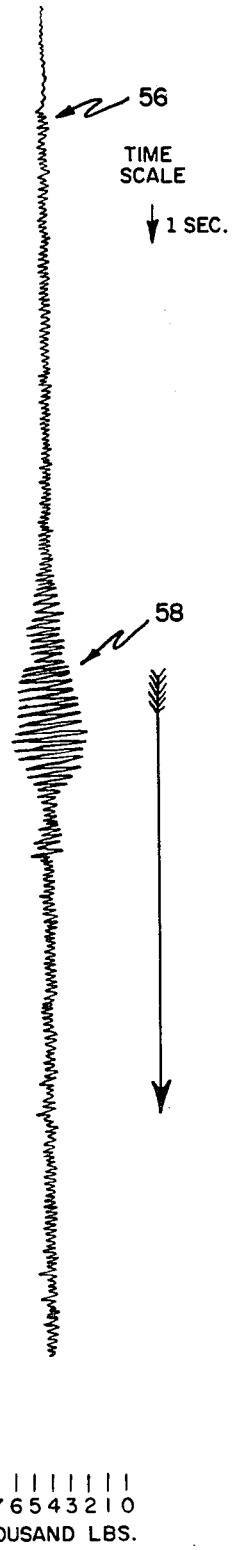
FIG. 7 is a recording similar to FIG. 6 but showing the tension variations during lowering of the load.

Correspondingly, in FIG. 7 the load as indicated in FIG. 6 is lowered. Oscillatory response as indicated at 56 occurs due to the sudden downward motion of the load. The resonant response indicated generally by the reference character 58 will also occur on the lowering motion of the load but as comparison between FIGS. 6 and 7 will show, the resonant response 58 occurs at a slightly shorter active length of chain. The reason for this is that the velocity of raising the load as depicted in FIG. 6 is less than the velocity at which the load is lowered in FIG. 7.

Figure 8:
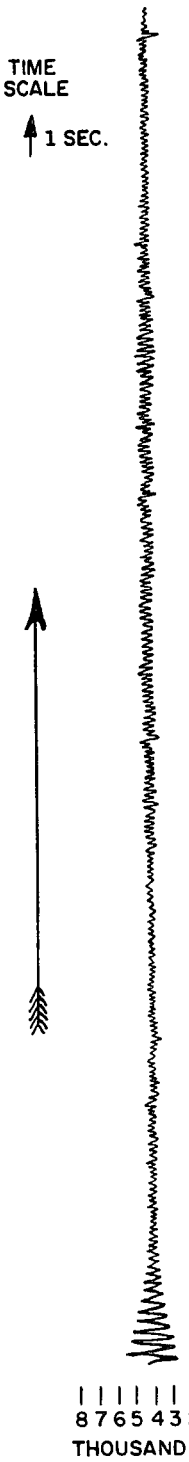
FIG. 8 is a recording identical to FIG. 6 but showing the effect of the present invention.

Referring now back to FIG. 1, the control means 34 according to the present invention, as previously described, involves a spring assembly 36 in parallel with a damping assembly 38. According to this invention, the spring rate $K_b$ of the spring assembly 36 is chosen to provide a controlled amplitude within the means 34 which is related to the damping factor $C_b$ of the damping means 38 such that energy is dissipated, during resonant responses such as those indicated at 52 and 58 in FIGS. 6 and 7 whereby the amplitudes of the variations of the tension in the chain and of course the forces acting on the entire load system inclusive of the components of the hoist, is significantly reduced. With reference to FIG. 8, same is a recording of the tension variations in the chain under the same conditions described in conjunction with FIG. 6 but with the control means 34 of this invention incorporated in the load system.

Figure 10:
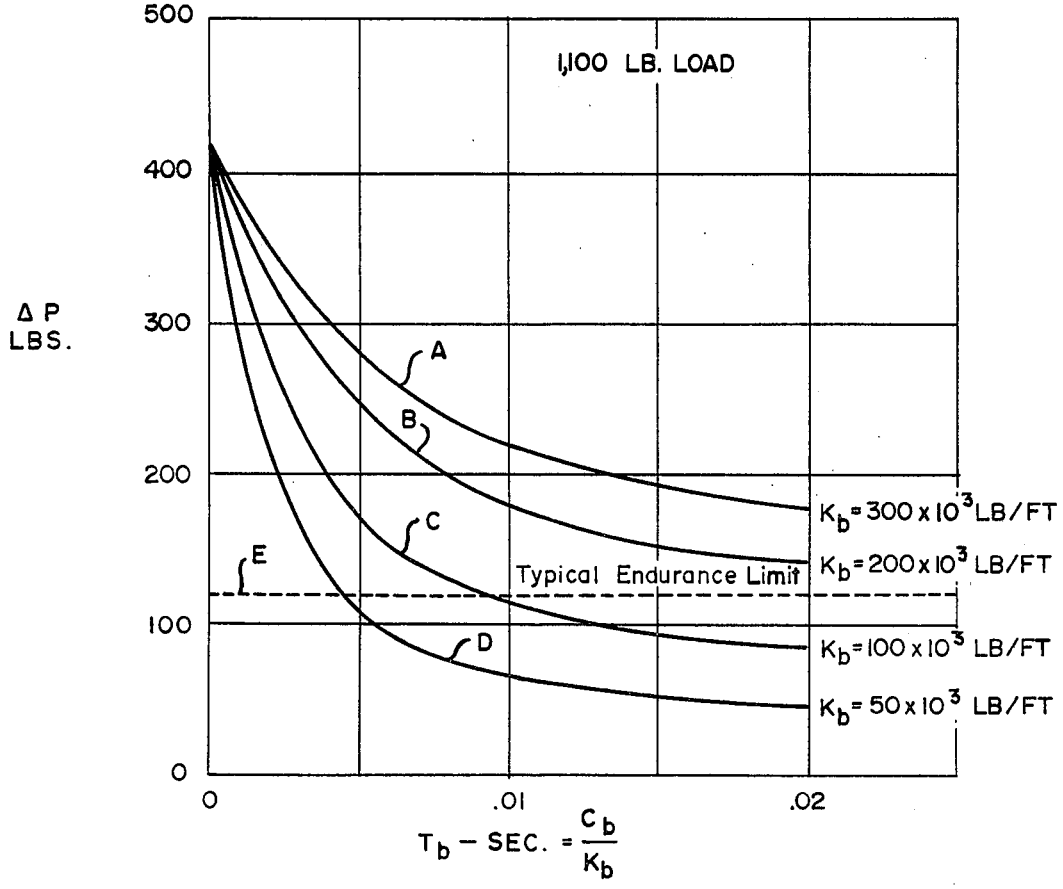
FIG. 10 is a graph illustrating certain principles according to the present invention.

Referring at this time more particularly to FIG. 10, which shows an example of typical theoretical hoist vibration characteristics, certain principles according to the present invention will be apparent therefrom. In FIG. 10, the ordinate represents the amplitude of the oscillating portion of the chain tension load at the condition for maximum resonant vibration response as shown generally at 52 or 58 in FIG. 6 or FIG. 7, and the abscissa represents the damper time constant $T_b$ equal to the damping factor $C_b$ divided by the spring rate $K_b$. The curves A,B,C and D represent vibration responses for different values of the spring rate $K_b$.

Curve A in FIG. 10 illustrates the tension force variations occurring in the active length of the chain when the spring rate $K_b$ is too high. Curve B represents the tension force amplitude variation response for a somewhat softer spring rate $K_b$ and, likewise, curves C and D represent even softer spring rates $K_b$.

As will be evident from FIG. 10, if the load system is to avoid a resonant response condition in which excessive tension force variations are imposed on the chain or hoist components, the values of $K_b$ and $C_b$ must be chosen such that the force amplitude variation does not exceed the endurance limit depicted in line E. Systems behaving according to A and B are deficient in this respect, while systems with characteristics represented by curves C and D can be made to have acceptably low tension variations by the proper choices of $T_b$.

In other words, the present invention encompasses the utilization of a spring or resilient means 36 having a particular spring rate value $K_b$ related to the value of the damping factor $C_b$ such that during resonant response periods, the endurance limits of the materials being stressed are not exceeded. Also, the control means 34 should be so designed that noticeable bouncing of the load does not occur during the resonant or transient responses.

Figure 9:
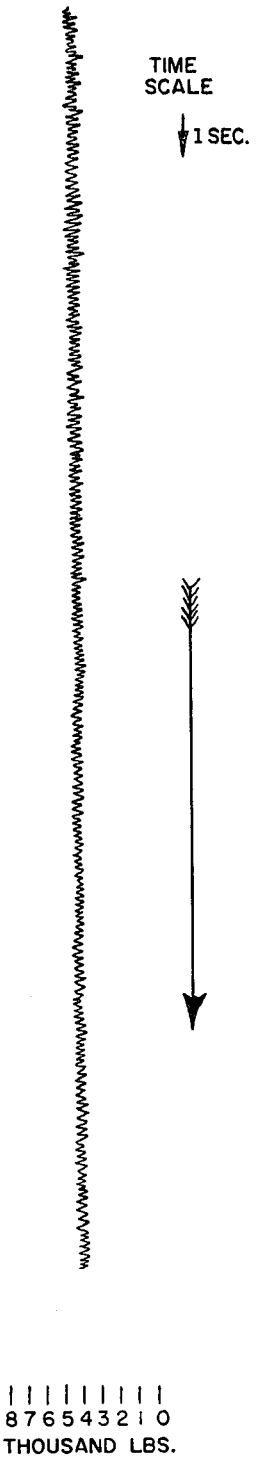
FIG. 9 is a recording identical to FIG. 7 but illustrating the effect of the present invention.

If the principles according to the present invention are followed, the tension force amplitude variations which occur as a result of starting or stopping a load are also substantially reduced, as reference to FIGS. 8 and 9 in comparison with corresponding FIGS. 6 and 7 will reveal.

Figure 4:
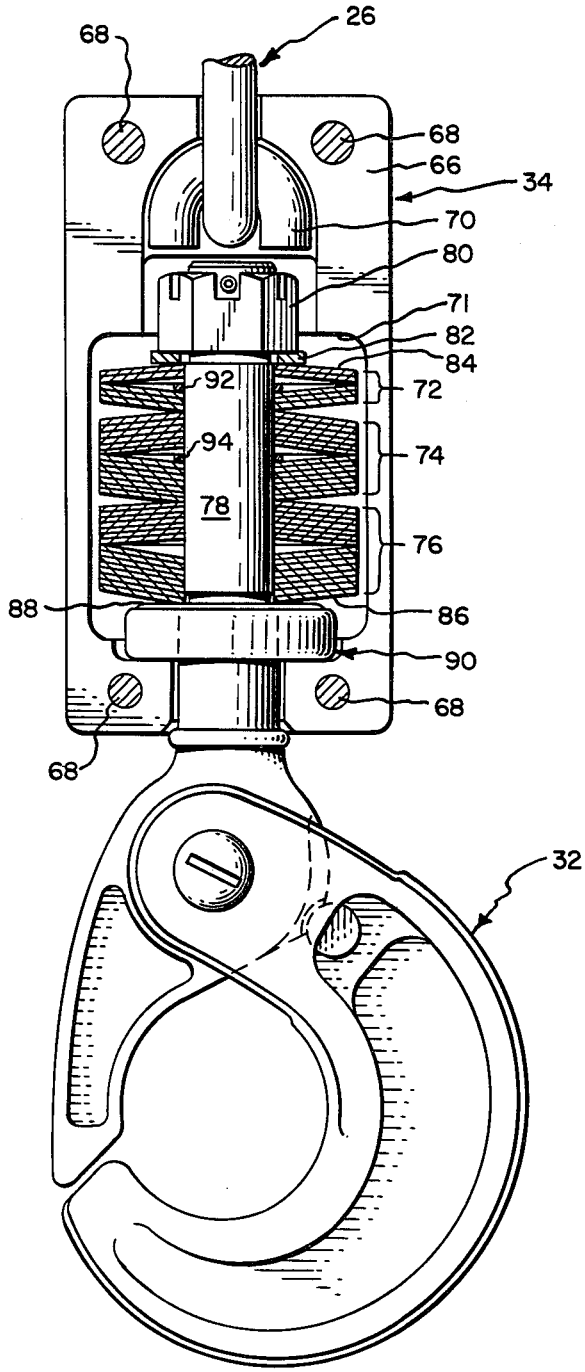
FIG. 4 is an enlarged elevational view illustrating a load hook attached to a hoist chain through the intermediary of the control means according to this invention.

With reference now more particularly to FIG. 2, the hoist illustrated in FIG. 1 is shown in detail therein. The hoist 18 is provided with the usual suspending hook 60 and incorporates a housing or casing 62 as shown, one end of the chain being dead ended as at 64 to the housing and being led internally of the housing to pass over the drive sprocket 24 as illustrated in phantom lines. The load engaging hook 32 is connected to the active length 26 of the chain through the control means 34 as is depicted in FIG. 1, the details of which are illustrated in FIG. 4. As is illustrated in FIG. 4, the control means includes a housing composed of two halves 66 secured together as by a plurality of bolts 68 or the like and which halves provide a hollow interior generally as shown. The interior of the housing holds a half link 70 captive therewithin by means of which the active length 26 of the chain is attached to the control means. The interior of the housing also presents a cylindrical recess 71 housing three sets of Belleville washers 72, 74 and 76. These Belleville washers are received on the shank 78 of the load hook 32, the upper end of which shank is threaded to receive the lock nut 80 which serves to transmit the hook load through the flat washer 82 to the uppermost Belleville washer 84 of the set 72. The lower washer 86 seats upon one race element 88 of the thrust bearing 90, the other race element of which seats upon the lower extermity of the housing halves 66. This arrangement allows the hook 32 freely to swivel with respect to the control means 34.

As will be apparent from FIG. 4, each of the sets 72, 74 and 76 contains a different number of Belleville washers and within each set, some of the washers are oriented in one direction and others are oriented in the opposite direction and, as will be obvious, each set will exhibit a different spring rate from the others. Such an arrangement has been found to be particularly advantageous in practical application of the invention and in general, the softest spring rate set 72 wil be tuned principally to dissipate energy encountered with resonant response encountered at approximately 50% of the rated load capacity of the hoist. The stiffest spring set 76 is tuned typically to dissipate energy when the hook load is 150% of rated capacity and the intermediate set 74 typically will be tuned to dissipate the energy encountered under resonant response when the hook load is 100% of the rated capacity of the hoist. Interposed between the oppositely directed Belleville washers of the set 72 is a spacing washer 92 which prevents the Belleville washers from obtaining a fully flattened condition which might otherwise harm them and a similar spacing washer 94 is interposed between the oppositely directed Belleville washers of the set 74.

The washers of each set operate to provide a spring rate determined by the number of washers in the set and the damping factor is attained by relative rubbing of the washers against each other so as to dissipate energy in the form of heat.

As noted, the various spring sets are tuned to various load conditions and the resonant response incurred under such loading conditions. As reference to FIG. 10 will show, which illustrates resonant response with an 1100 lb. load, the tension force fluctuation $\Delta P$ can be quite large under resonant conditions, see also FIGS. 6 and 7 which show fluctuations in the order of $\pm 50\%$ of the load. In accordance with the present invention, the tuning of a spring set of this invention should produce a fluctuation of the tension producing force of not more than about $\pm 10\%$ of the load and the spring compliance of any set should be equal at least to about ½ the spring compliance of the active length of the chain under resonant conditions but not more than about three times such spring rate of the chain. Furthermore, as a rule of thumb, the value of $T_b$ should not be less than about 0.006 seconds. Generally speaking, the spring rate of a tuned spring set should be soft enough to allow a controlled amplitude of relative motion within the control means as allows the damping factor to dissipate energy such that the $\Delta P$ is not more than about $\pm 10\%$ of the load.

As noted, a plurality of spring sets arranged in series is desirable in order to achieve excellent energy dissipation over a wide range of load and resonant response characteristics. However, it is to be noted that no tuning should be required for loads less than about 50% of the rated capacity since even if resonant response occurs with respect to such loads, it is not likely that the endurance limit of the chain or other components will be reached in this range of loads. In this respect, it is to be understood that the greatest danger lies in connection with resonant response occurring with full or overload capacity and it is for this reason that the design in any event should accommodate for resonant response at the overload condition, say 150% of the rated capacity of the hoist, bearing in mind that in actual use the hoist can be expected to be abused to this extent.

Figure 3:
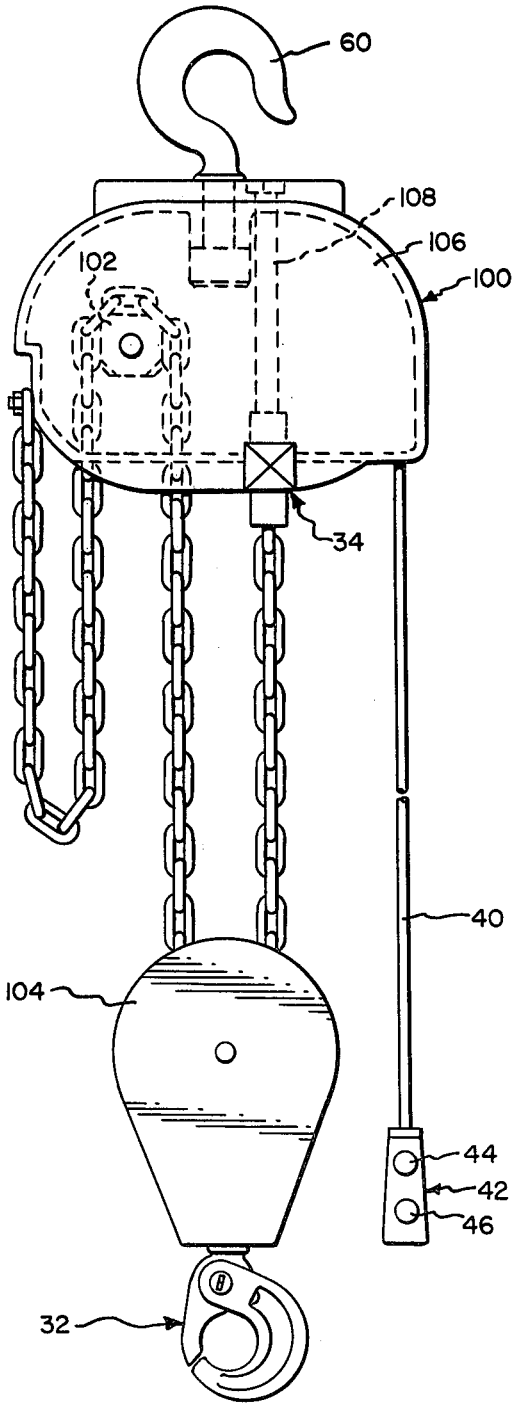
FIG. 3 is an elevational view similar to FIG. 2 but showing a different form of chain hoist mechanism.

FIG. 3 illustrates a modified form of hoist 100 which, as compared to the hoist of FIG. 2, ordinarily would be a hoist of larger capacity. In this case, the drive sprocket 102 is again driven at constant speed by an associated powered device such as an electric motor but in the embodiment of FIG. 3, the chain is double reeved to pass over an idler pulley within the hook block assembly 104 and then is dead ended to the frame or casing 106 by means of the anchor bolt 108. In such an arrangement, the control means 34 could advantageously be located at the dead ended portion of the chain as illustrated in FIG. 3 rather than at the hook 32 mounting because the full amplitude of the excitation is experienced at this point rather than the half amplitude experienced by the hook block 104. Similarly, the control means 34 in FIG. 2 or 3 could as well be located between support hook 60 and the hoist assembly 18 and, in any event, it will be appreciated that the control means is located serially within the load system in order effectively to dissipate the energy which would otherwise produce excessive motion and stress-producing forces under resonant response conditions.

Figure 5:
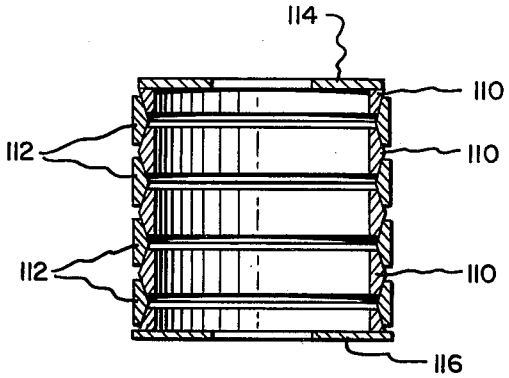
FIG. 5 is a vertical section taken through a modified form of control means.

FIG. 5 illustrates a modified form of control means. In the arrangement shown, there is an inner set of annular resilient members 110 and an outer set of annular resilient members 112 positioned between the upper and lower force transmitting plates 114 and 116. All of the outer annular members 112 are provided with inner surfaces which are double beveled as shown whereas all but the upper and lower inner annular members are double beveled on their outer surfaces, the upper and lower inner elements being provided with a single bevel surface and with all of the various bevel surfaces interfitting as shown in FIG. 5 so that when loads are imposed to urge the plates 115 and 116 together, the outer elements 112 expand while the inner elements 110 contract to provide the requisite spring rate and whereby there are relative sliding motions effected between the various beveled surfaces to create the energy dissipation.

It will be understood that whatever the form of control means is used, the coefficient of friction which creates the energy dissipation may be adjusted and preferably is so chosen as to achieve smooth operation. For example, the various spring sets of FIG. 4 may be lubricated to achieve smooth transition between the static and dynamic states, and to introduce damping forces proportional to the relative sliding velocity of the damper elements, friction material may be interposed between the various washers, the washers may be coated with desired friction material, or the like.

It will be understood that as used herein, spring rate is expressed in units such as pounds per inch, damping factor is expressed in units such as pounds per inch-second and spring compliance is the reciprocal of spring rate.

What is claimed is:

1. In a load handling system which includes a hoist, means for suspending said hoist, a chain suspended in operative association from said hoist, means for attaching said chain to a load, said hoist including a drive sprocket engaging said chain and power operated means for driving said drive sprocket at substantially constant angular velocity to effect variation in the chain length between the drive sprocket and the load whereby correspondingly to raise and lower the load, the driving of the chain by the drive sprocket inherently setting up a vertically oscillatory excitation superimposed on the steady vertical motion of the chain whereby as said variation in chain length inherently causes the system to experience a continuously varying natural frequency, said oscillatory excitation sets up a resonant response in the load system when said natural frequency coincides with the fundamental or a significant harmonic frequency of said excitation wherein excessive oscillatory motion and forces are imposed on the system, the improvement which comprises:

control means in said system for obtaining a controlled amplitude of relative motion within such control means in response to said oscillatory motion and for creating a damping force related to said controlled amplitude which significantly reduces said excessive oscillatory motion and forces.

2. In a load handling system as defined in claim 1 wherein said control means comprises at least one set of Belleville washers.

3. In a load handling system as defined in claim 2 wherein said Belleville washers are arranged in opposing relation to each other.

4. In a load handling system as defined in claim 3 wherein the number of Belleville washers is chosen to provide a spring compliance at least as great as ½ the spring compliance of said chain at said resonant response, and wherein said washers provide a damping factor which when divided by the value of the spring rate of the washers is at least 0.006 seconds.

5. In a chain hoist including a drive sprocket, a drive motor for rotating said drive sprocket at a fixed angular speed, and a chain trained over said drive sprocket for suspending a load therefrom, a resonant response created in said chain by the interaction between said chain and said sprocket, the improvement which comprises:

control means cooperating with said chain in suspending the load for dissipating sufficient energy to maintain any oscillatory amplitude of the load below that level which would cause the endurance limit of the chain and hoist components to be exceeded, said control means includes at least one spring device having a spring compliance at least equal to ½ that of the chain at said resonant response and having an internal damping factor which when divided by the value of the spring rate of the spring device is at least about 0.006 seconds.

6. In a chain hoist as defined in claim 5 wherein said control means maintains said oscillatory amplitude below that value which would impose a force on said chain exceeding about 110% of the load.

7. In a chain hoist including a drive sprocket, a drive motor for rotating said drive sprocket at a substantially constant angular velocity, and a chain trained over said drive sprocket for suspending a load therefrom, the improvement which comprises:

at least two spring sets cooperating with said chain to suspend the load, one of said sets being tuned in spring rate and damping factor to dissipate at least a significant portion of the energy generated under resonant response incidental to one value of applied load and the other of said sets being tuned in spring rate and damping factor to dissipate at least a significant portion of the energy generated under resonant response incidental to another value of applied load.

8. In a chain hoist having a drive sprocket, a chain trained over the drive sprocket to suspend a load, and drive means for rotating said drive sprocket at a constant angular velocity to move the load vertically whereby the system passes through one or more resonant responses while the load is moving, the improvement which comprises:

control means tuned to said resonant responses and comprising at least one spring set of predetermined spring rate and damping means operating in parallel with said spring set for dissipating a significant portion of energy arising from said resonant responses.

9. In a load handling system which includes a hoist, means for suspending said hoist, a chain suspended in operative association from said hoist, means for attaching said chain to a load, said hoist including a drive sprocket engaging said chain, and power operated means for driving said drive sprocket at substantially constant angular velocity whereby as the load is raised and lowered the chain irregularly trains over said sprocket to superimpose an oscillatory movement on the vertical motion of the load which causes the system to experience a resonant response when the active length of the chain approaches a value which causes the system to have a natural frequency related to the fundamental or a significant harmonic frequency of said oscillatory movement whereby the load system experiences oscillatory motion and consequent stress-inducing forces, the improvement which comprises:

control means in said system for allowing a controlled amplitude of relative motion within such means and for creating a damping force related to said controlled amplitude which significantly reduces said oscillatory motion and stress-inducing forces.

10. In a load handling system as defined in claim 1 wherein said control means comprises at least one resilient washer and a friction surface against which said washer rubs when said washer is deformed by variation in force applied thereto.

11. In a load handling system as defined in claim 10 wherein the spring compliance of said control means lies in the range of about ½–3 times the spring compliance of the active length of said chain at said resonant response of the system.

12. In a load handling system as defined in claim 1 wherein the spring compliance of said control means lies in the range of about ½–3 times the spring compliance of the active length of said chain at said resonant response of the system.

13. In a load handling system as defined in claim 2 wherein the spring compliance of said control means lies in the range of about ½–3 times the spring compliance of the active length of said chain at said resonant response of the system.

14. In a chain hoist including a drive sprocket, a drive motor for rotating said drive sprocket at a substantially constant angular velocity, and a chain trained over said drive sprocket for suspending a load therefrom, the improvement which comprises:

at least two resilient devices disposed in series and cooperating with said chain to suspend the load, one of said devices having a spring rate and a damping factor which are tuned to dissipate at least a significant portion of the energy generated under resonant response incidental to one value of applied load, and the other of said devices having a spring rate and a damping factor which are tuned to dissipate at least a significant portion of the energy generated under resonant response incidental to another value of applied load.

15. In a load handling system as defined in claim 1 wherein said control means comprises at least one set of Belleville washers including a plurality of nested Belleville washers disposed in face-to-face contact.

16. In a load handling system which includes a hoist, means for suspending said hoist, a chain suspended in operative association from said hoist, means for attaching said chain to a load, said hoist including a drive sprocket engaging said chain and power operated means for driving said drive sprocket at substantially constant angular velocity to effect variation in the chain length between the drive sprocket and the load whereby correspondingly to raise and lower the load, the driving of the chain by the drive sprocket inherently setting up a vertically oscillatory excitation superimposed on the steady vertical motion of the chain whereby as said variation in chain length inherently causes the system to experience a continuously varying natural frequency, said oscillatory excitation sets up a resonant response in the load system when said natural frequency coincides with the fundamental or a significant harmonic frequency of said excitation wherein excessive oscillatory motion and forces are imposed on the system, the improvement which comprises:

control means in said system for providing a combination of a selected spring rate and a selected damping factor which maintains the peak stresses in said chain, during said resonant response, below the endurance limit of said chain.

17. In a load handling system as defined in claim 16 wherein said control means is detailed in design such that said damping factor divided by said spring rate is equal to at least 0.006 seconds.

18. In a load handling system as defined in claim 17 wherein said control means comprises at least two spring sets each including a plurality of resilient members disposed in nested, rubbing contact, one of said spring sets being tuned in spring rate and damping factor to dissipate at least a significant portion of the energy generated under resonant response incidental to one value of applied load and the other of said spring sets being tuned in spring rate and damping factor to dissipate at least a significant portion of the energy generated under resonant response incidental to another value of applied load.

19. In a load handling system as defined in claim 16 wherein said control means comprises at least two spring sets each including a plurality of resilient members disposed in nested, rubbing contact, one of said spring sets being tuned in spring rate and damping factor to dissipate at least a significant portion of the energy generated under resonant response incidental to one value of applied load and the other of said spring sets being tuned in spring rate and damping factor to dissipate at least a significant portion of the energy generated under resonant response incidental to another value of applied load.

20. In a load handling system as defined in claim 16 wherein said control means comprises three spring sets each including a plurality of resilient members disposed in nested, rubbing contact, one of said spring sets being tuned in spring rate and damping factor to dissipate the energy generated under resonant response incidental to a load value equal to 50% of the rated load of the system, a second spring set being tuned in spring rate and damping factor to dissipate the energy generated under resonant response incidental to a load value equal to 100% of the rated load, and the third spring set being tuned in spring rate and damping factor to dissipate the energy generated under resonant response incidental to a load value equal to 150% of the rated load.

21. In a chain hoist including a drive sprocket, a drive motor for rotating said drive sprocket at a substantially constant angular velocity, and a chain trained over said drive sprocket for suspending a load therefrom, the improvement which comprises:

control means for dissipating resonant energy imposed on said chain incidental to raising and lowering the load, said control means comprising at least two spring sets cooperating with said chain to suspend the load, one of said sets being tuned in spring rate and damping factor to dissipate at least a significant portion of the energy generated under resonant response incidental to one value of applied load and the other of said sets being tuned in spring rate and damping factor to dissipate at least a significant portion of the energy generated under resonant response incidental to another value of applied load.

22. In a chain hoist including a drive sprocket, a drive motor for rotating said drive sprocket at a substantially constant angular valocity, and a chain trained over said drive sprocket for suspending a load therefrom, the improvement which comprises:

control means for dissipating resonant energy imposed on said chain incidental to raising and lowering the load, said control means comprising at least two resilient devices disposed in series and cooperating with said chain to suspend the load, one of said devices having a spring rate and a damping factor which are tuned to dissipate at least a significant portion of the energy generated under resonant response incidental to one value of applied load, and the other of said devices having a spring rate and a damping factor which are tuned to dissipate at least a significant portion of the energy generated under resonant response incidental to another value of applied load.

23. In a chain hoist as defined in claim 22 wherein each resilient comprises a plurality of resilient elements disposed in nested, rubbing relation.

24. In a chain hoist as defined in claim 21 wherein each spring set comprises a plurality of resilient element disposed in nested, rubbing relation.

* * * * *

UNITED STATES PATENT AND TRADEMARK OFFICE

CERTIFICATE OF CORRECTION

PATENT NO. : 4,165,863

DATED : August 28, 1979

INVENTOR(S) : Kenneth D. Schreyer

It is certified that error appears in the above-identified patent and that said Letters Patent are hereby corrected as shown below:

Column 12, line 55 (claim 23) after the word "resilient" the word --device-- should be inserted.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*